US005842616A

United States Patent [19]

Ruscitti et al.

[11] Patent Number: 5,842,616

[45] Date of Patent: Dec. 1, 1998

[54] ATOMIZED LIQUID DISPENSER APPLICABLE TO MANUALLY OPERATED PUMPS

[75] Inventors: Tommaso Ruscitti, Milan; Franco Carlappi, Piacenza; Antonino Ragno, Milan, all of Italy

[73] Assignee: TER S.r.l., Milan, Israel

[21] Appl. No.: 794,909

[22] Filed: Feb. 4, 1997

[30] Foreign Application Priority Data

Apr. 24, 1996 [IT] Italy ..... MI96A0818
Nov. 22, 1996 [IT] Italy ..... MI96A2447

[51] Int. Cl.[6] ..... B05B 1/30

[52] U.S. Cl. ..... 222/321.3; 222/380; 222/496; 239/570

[58] Field of Search ..... 239/570, 583, 239/333, 473; 222/321.3, 321.7, 321.8, 321.9, 380, 496

[56] References Cited

U.S. PATENT DOCUMENTS

| | | | |
|---|---|---|---|
| 4,182,496 | 1/1980 | Burke | 222/380 X |
| 5,127,579 | 7/1992 | Tempelman | 239/570 X |
| 5,195,665 | 3/1993 | Lina | 239/570 X |
| 5,197,638 | 3/1993 | Wood | 239/570 X |
| 5,558,258 | 9/1996 | Albini et al. | 222/380 X |
| 5,657,930 | 8/1997 | Battegazzore | 239/570 X |

FOREIGN PATENT DOCUMENTS

| | | | |
|---|---|---|---|
| 686433 A2 | 12/1995 | European Pat. Off. . | |
| 3315334 A1 | 10/1984 | Germany | 222/321.3 |
| 1230667 | 5/1971 | United Kingdom | 239/570 |

*Primary Examiner*—Kenneth Bomberg
*Attorney, Agent, or Firm*—Oblon, Spivak, McClelland, Maier & Neustadt, P.C.

[57] ABSTRACT

An atomized liquid dispenser applicable to the stem of manually operated pumps for dispensing a liquid enclosed in a container, the dispenser having an elongate chamber housing a movable piston from which there projects an appendix urged by a spring towards a discharge or dispensing nozzle, a portion of the appendix being insertable into and sealedly movable within a cylindrical seat in an insert in which there is provided the nozzle opening into the seat, a stop element being provided for retaining the piston, when in its rest position, with the free end of the appendix spaced from the end of the seat in the insert.

3 Claims, 1 Drawing Sheet

ATOMIZED LIQUID DISPENSER APPLICABLE TO MANUALLY OPERATED PUMPS

Figure 1:
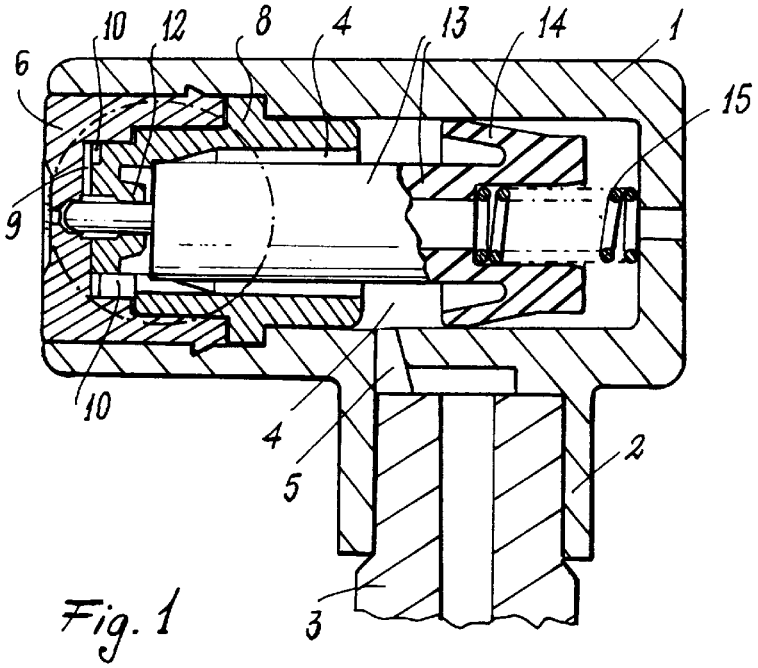

This invention relates to an atomized liquid dispenser applicable to manually operated pumps.

To dispense pressurized liquids in finely atomized form it is known to use manually operated pumps with a hollow liquid delivery stem on which a dispensing head is mounted incorporating a chamber into which the pressurized liquid arrives from the pump stem. The pressurized liquid emerges to the outside in atomized form after passing through a discharge nozzle, upstream of and in correspondence with which there is provided a series of channels meeting in the nozzle, within which the fluid undergoes a strong vorticose movement before being expelled to the outside.

To achieve good and constant atomization without liquid dripping from the outside of the discharge nozzle the liquid pressure at this nozzle, when dispensing commences or ceases, must be sufficiently high from the beginning. Up to the present time this problem has been partly solved by constructing dispensers applicable to the stems of manually operated pumps which withdraw the liquid from the interior of a container and expel it under pressure to the outside through said stems. Said dispensers define an elongate chamber in which there is housed in a sealedly movable manner a piston from which there projects an appendix extending towards the discharge nozzle provided at one end of the dispenser, in which there is also housed a spring acting on the piston such that its appendix is urged (under rest conditions) towards an insert in which said nozzle is formed, means being provided to seal said chamber in proximity to the nozzle.

Dispensers of the aforesaid type, which ensure the maintenance of a substantially constant dispensed liquid pressure, are described for example in U.S. Pat. No. 4,182,496, U.S. Pat. No. 5,558,258 and the corresponding EP-A-686433, and in EP-A-688608. These have serious defects, one of which is the fact that the piston appendix (which is simply pressed against the opposing surface of the insert comprising the discharge nozzle) is not able to provide (under rest conditions) perfect isolation for the liquid present within the dispenser upstream of the discharge nozzle, and prevent air entry. If the liquid is hair lacquer, dressing liquid or the like, it tends to rapidly dry, so hindering or totally preventing atomized dispensing of the liquid on operating the pump. In the case of EP-A-688608 there is indeed provided a seal between the movable piston and a bush housed within said chamber, but the liquid portion which remains present between this seal and the discharge nozzle is not sufficiently isolated towards the outside, with the said result.

A second drawback derives from the fact that the tip of the piston appendix is thrust with considerable force (by the spring acting on the piston) against the insert comprising the discharge nozzle, so easily becoming ruined or broken because of the very small dimensions of the appendix.

An object of the present invention is to provide an improved dispenser which is economical and of simple structure and is free of all the aforesaid drawbacks, in that it provides perfect isolation of the liquid present in the dispenser upstream of the discharge nozzle when under rest conditions and with the dispenser and pump primed, it provides easy priming of the pump and filling of the dispenser chamber on initially being used, and it prevents any possibility of damage to the appendix which closes the discharge nozzle.

This and further objects are attained by an atomized liquid dispenser comprising a seat for its fixing onto the free end of a pump stem and communicating with an elongate chamber closed at one of its ends by an insert traversed by a discharge nozzle, in said chamber there being movably housed a piston, in proximity to one end of which there projects at least one lip which seals against the surface of said chamber, from the other end of the piston there projecting an appendix which is urged towards said nozzle by a spring acting on said piston, characterised in that within said chamber there extends a stop against which, when under rest conditions, said spring urges said piston while the end of said appendix remains spaced from the opposing surface of said insert, there being provided within said insert in correspondence with said nozzle an at least partially cylindrical seat into which a corresponding cylindrical portion of said appendix can be sealedly inserted, the length of the piston and of its appendix being such that the removal of the piston from its rest position causes firstly the removal of the piston from the respective stop, followed by the emergence of said cylindrical portion of said appendix from the respective cylindrical seat provided in said insert.

Figure 2:
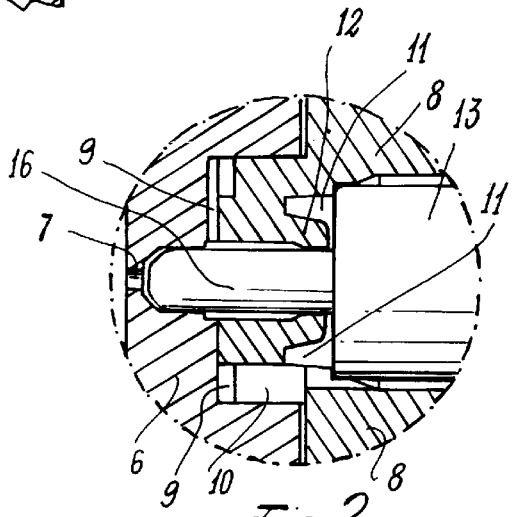
Figure 3:
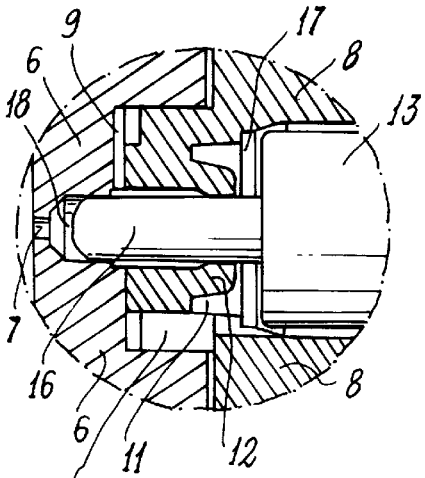
Figure 4:
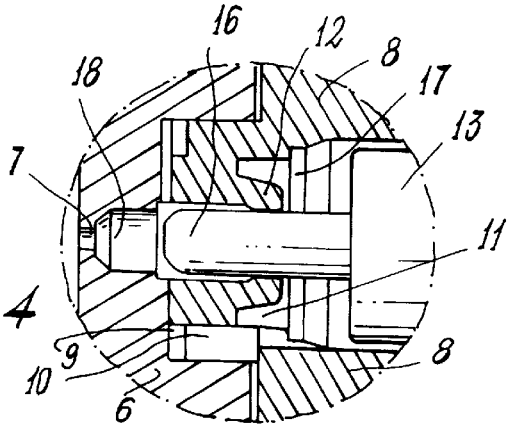

The structure and characteristics of the liquid dispenser according to the invention will be more apparent from the description of a preferred embodiment thereof given hereinafter by way of non-limiting example with reference to the accompanying drawing, on which:

FIG. 1 is a schematic longitudinal section through a liquid dispenser mounted on the end of a pump stem; and FIGS. 2 to 4 show to an enlarged scale that portion of the dispenser close to the discharge nozzle, respectively in the closed position, in an intermediate position and in the liquid dispensing position.

The dispenser shown on the drawings comprises a hollow head 1 provided with a seat (bounded by a tubular wall 2) into which there can be inserted and retained the free end of the hollow stem 3 of a mechanical pump (not shown) of any known type, able to dispense fluids under pressure each time it is manually operated.

In the head 1 there is provided a chamber 4 which communicates with said seat via a hole 5. The cavity in the head 1 is closed by an insert 6 traversed by a nozzle 7 through which the atomized fluid is discharged to atmosphere.

The chamber 4 also houses a bush 8 the front surface of which rests against that of the insert 6, and in which there are provided spiral channels 9 meeting at the nozzle 7.

The radially more outer ends of the channels 9 communicate via passages 10 with a cavity 11 provided upstream of a wall 12 forming part of the bush 8 and traversed by a hole coaxial with the nozzle 7.

The cavity in the head 1 houses a slidable piston 13 provided with a lip 14 which is sealedly slidable along a corresponding cylindrical surface of the cavity in the head 1. As can be seen from the drawing, a compressed spring 15 acts on one end of the piston 13, from the other end of which there projects an elongate cylindrical appendix 16 which passes through and is guided within the hole provided in the wall 12 of the bush 8.

The structure of the aforedescribed dispenser is substantially analogous to that of U.S. Pat. No. 4,182,496, EP-A-0688608 and U.S. Pat. No. 5,558,258.

One characteristic of the dispenser of the present invention is that in the bush 8 there is provided a seat 17 (FIGS. 3 and 4) into which, when under rest conditions (FIG. 2), the adjacent end portion of the piston 13 is inserted. The seat 17 is bounded at its left end (with respect to the figures) by a step forming a stop against which the piston 13 bears when under rest conditions (FIG. 2). When under such rest conditions, the piston 13 does not seal against the seat 17 so that the liquid present in the chamber 4 also fills the space between that piston end facing the wall 12 of the bush 8 and the wall 12 itself.

A further fundamental characteristic of the dispenser is that, in the inner part of the insert 6 in correspondence with the nozzle 7, there is provided a seat or recess 18 at least partly bounded by a cylindrical surface, and in which a portion of the cylindrical appendix 16 can be sealedly housed.

Essential characteristics of the dispenser include the fact that when under rest conditions, ie when the piston 13 is inserted into the seat 17 and is retained by the step which delimits this seat, the tip or end of the appendix 16 remains free (FIG. 2), ie spaced from the opposing surface of the insert 6, hence not suffering damage by the effect of the thrust of the spring 15, because it does not come into contact with the adjacent surface of the insert 6; the fact that when under rest conditions, that portion of the cylindrical appendix 16 inserted into the cylindrical seat in the insert forms an effective seal which isolates the liquid present around the appendix from contact with the air; and the fact that starting from the rest state (FIG. 2), when the piston begins to move by overcoming the action of the spring 15 (by the effect of the pressure of the liquid reaching the chamber 4 through the stem 3), the piston firstly withdraws from the stop step provided in the seat 17 of the bush 8 while the cylindrical appendix 16 continues to form a seal (FIG. 3) within the cylindrical seat 18 of the insert 6 (so that the liquid about the appendix and filling the channels 9 is under pressure), after which the appendix 16 becomes released from this seat (FIG. 4) to enable the liquid to discharge to the outside under pressure instantaneously when opening begins, so preventing liquid dripping from the outside of the nozzle. This latter characteristic is also very important during cessation of delivery, because (in passing from the position shown schematically in FIG. 4 to that shown in FIG. 2) the appendix 16 firstly suddenly interrupts liquid passage to the discharge nozzle (FIG. 3) while the liquid is still under pressure, and only afterwards (FIG. 2) does the piston 13 halt against the stop step in the seat 17 of the bush 8, after a substantial portion of the appendix 16 has penetrated into the cylindrical seat 18 in the insert 6, to ensure excellent sealing when the dispenser is under rest conditions.

It is also important to note that as that end of the piston 13 inserted into the seat 17 in the bush 8 (when under rest conditions) does not seal against said seat, the liquid filling the chamber 4 also fills the space bounded by the wall 12 of the bush 8 and by the opposing front surface of the piston. In this manner when the liquid is pressurized by the pump on which the dispenser is mounted, the pressurized liquid present in this space provides an important contribution to causing the piston to move by overcoming friction and the thrust of the spring 15.

As an alternative to the aforesaid embodiment, the seat 17 in the bush 8 can be shaped such that (for example by simply eliminating the longitudinal groove provided in the lower part of this seat, as shown on the drawings) that end of the piston 13 which is inserted into it when under rest conditions seals against the seat. In such a case a double sealing system is provided in the dispenser, in which case the end of the piston 13 must be released from the seat 17 in the bush 8 before the appendix 16 is released from the respective sealing seat provided in the insert 6, during the initial rearward movement of the piston at the moment of its operation.

It is evident that the form of the dispenser can be different from that illustrated on the drawings, for example the bush 8 can be dispensed with (in which case the stop for the piston 13 can be provided directly on the insert 6) or can be of the type represented in the initially cited patents, or that mechanisms can be provided (such as that described in European patent application 96109385.3 in the name of the present applicants) to contribute mechanically to the rearward movement of the piston 13.

Still for example, the metal spring 15 can be replaced by at least one elastically flexible appendix (or by an elastically deformable corrugated tubular wall) integral with and axially projecting from the back end of the piston 13, the free end of said appendix or wall resting and pressing against the head surface facing said piston back end; obviously, if desired, the above mentioned flexible appendix or corrugated tubular wall can be made integral with the head 1 and axially project therefrom, with its free end resting and pressing against the back end of the piston 3.

We claim:

1. An atomized liquid dispenser comprising:

a head having an elongate chamber;

a seat formed in said head configured to communicate with a first end of a pump stem, and wherein said seat is further configured to communicate with said elongate chamber;

an insert provided in a first end of said chamber, wherein said insert includes a nozzle;

a piston movably housed within said chamber, said piston including a lip projecting from a first end of said piston which provides a seal against an inner surface of said chamber;

an appendix projecting from a second end of said piston;

a stop formed within said chamber, proximate to said nozzle;

a spring configured to bias said piston against said stop; and an at least partially cylindrical seat provided in said insert, said at least partially cylindrical seat being configured to provide a seal with an at least partially cylindrical portion of said appendix;

wherein said appendix remains spaced from an opposing surface of said insert when said piston abuts said stop;

wherein a length of said piston and a length of said appendix are such that said piston can be moved a predetermined distance away from said stop without removing said cylindrical portion of said appendix from said cylindrical seat.

2. A dispenser as claimed in claim 1, further comprising a bush, wherein said stop is provided on said bush.

3. A dispenser as claimed in claim 2, wherein said stop further comprises a seat formed in said bush, said seat configured to provide a seal between said bush and said piston.

* * * * *

UNITED STATES PATENT AND TRADEMARK OFFICE

CERTIFICATE OF CORRECTION

PATENT NO. : 5,842,616

DATED : December 1, 1998

INVENTOR(S): Tommaso RUSCITTI et al.

It is certified that an error appears in the above-identified patent and that said Letters Patent is hereby corrected as shown below:

On the title page, item [73], the Assignee information should be:

--TER S.r.l., Milan, Italy--

Signed and Sealed this

Tenth Day of August, 1999

*Attest:*

Q. TODD DICKINSON

*Attesting Officer*

*Acting Commissioner of Patents and Trademarks*